United States Patent [19]

Yokoya

[11] 4,449,230

[45] May 15, 1984

[54] APPARATUS FOR DEMODULATING AN AM STEREOPHONIC SIGNAL

[75] Inventor: Satoshi Yokoya, Chofu, Japan

[73] Assignee: Sony Corporation, Tokyo, Japan

[21] Appl. No.: 364,620

[22] Filed: Apr. 1, 1982

[30] Foreign Application Priority Data

Apr. 7, 1981 [JP] Japan ..... 56-52265

[51] Int. Cl.[3] ..... H04H 5/00

[52] U.S. Cl. ..... 381/15; 381/2

[58] Field of Search ..... 179/1 GS; 381/15, 2

[56] References Cited

U.S. PATENT DOCUMENTS 4,170,716 10/1979 Hilbert et al. ..... 179/1 GS
4,349,696 9/1982 Akitake et al. ..... 179/1 GS
4,368,355 1/1983 Ichikawa ..... 179/1 GS

*Primary Examiner*—R. J. Hickey
*Attorney, Agent, or Firm*—Lewis H. Eslinger; Alvin Sinderbrand

FOREIGN PATENT DOCUMENTS 1450533 8/1972 United Kingdom.

[57] ABSTRACT

A stereo demodulating circuit for an AM stereo receiver includes an IF stage for producing an IF signal from a received AM stereo signal of the type having a carrier amplitude-modulated with the sum of left and right channel signals and the carrier phase-modulated with the difference of the left and right channel signals; an envelope detector for producing a sum signal corresponding to the sum of the left and right channel signals in response to the IF signal, and having level information, amplitude-modulation information and a DC component; a negative peak limiter for limiting the minimum level of the sum signal from the envelope detector; a divider for dividing the IF signal by the sum signal with its minimum level limited to produce a phase-modulation signal; a phase-locked loop for producing a non-modulation signal from the IF signal; a low-pass filter for removing the amplitude-modulation information from the sum signal from the envelope detector to produce a level information signal having only the level information; a second negative peak limiter for limiting the minimum level of the level information signal; a multiplier for multiplying the level information signal with its minimum level limited, the non-modulation signal and the phase-modulation signal to produce a difference signal; and a matrix from reproducing the left and right channel signals in response to the sum signal with its DC component removed and the difference signal with a carrier component thereof removed.

17 Claims, 6 Drawing Figures

APPARATUS FOR DEMODULATING AN AM STEREOPHONIC SIGNAL

BACKGROUND OF THE INVENTION

This invention relates generally to radio receivers and, more particularly, is directed to an AM stereophonic broadcast receiver.

Systems for transmitting and receiving AM stereo signals are known in the art. In one such system, disclosed in U.S. Pat. No. 4,194,088, a double modulation system is used in which a sum signal (L+R) comprised of a left channel stereophonic signal (L) and a right channel stereophonic signal (R) is used to AM-modulate a carrier signal and a difference signal (L−R) is employed to phase-modulate the carrier signal. With such system, an AM stereophonic broadcast receiver is provided and includes a demodulating circuit having an AM detector in a main channel demodulator path to derive the sum signal (L+R) from an IF signal, a sub-channel demodulator path also receiving the IF signal and deriving therefrom the difference signal (L−R), and a matrix circuit for providing left (L) and right (R) channel stereophonic signals at respective outputs thereof in response to the sum signal (L+R) and the difference signal (L−R). In addition, a pilot signal which has been superimposed upon the phase-modulated difference signal (L−R) is separated therefrom in the AM stereo receiver for use in stereophonic display and the like. Alternatively, the difference signal may be used to frequency-modulate the carrier signal in systems of the type used by Belar Electronic Laboratory, Inc.

With such AM stereo receivers, an amplitude limiter is provided in the sub-channel demodulator path and functions to remove amplitude modulations of the intermediate frequency signal such that a substantially constant amplitude signal is produced. This is accomplished by providing a strong limiting characteristic to the amplitude limiter. However, if a noise component is superimposed on the intermediate frequency signal, loud abnormal sounds or noise bursts, for example, scratching and crunching sounds, are produced as a result of the limiting action of the amplitude limiter and which result in substantial deterioration of the reproduced sound. This phenomenom is particularly noticeable if excessive negative modulation occurs. As a result thereof, there occurs deterioration of the left-channel and right-channel information.

In an attempt to resolve the aforementioned problems, it has been proposed to weaken the negative modulation at the transmitter end. However, such proposed method is not preferred because of deterioration in the reproduced sound. Accordingly, a system has been proposed by the applicant herein along with others to obviate the above disadvantages. With such system, the intermediate frequency signal from an intermediate frequency amplifier is of the form:

$$A(1+L+R)\cos(\omega t+L-R)$$

In the above equation, the (L+R) portion of the amplitude component corresponds to the aforementioned sum signal, the (L−R) portion of the phase-modulation component corresponds to the aforementioned difference signal, $\omega$ corresponds to the angular frequency of the carrier signal and A corresponds to the level information of the AM stereo signal. As with the aforementioned AM stereo system, the above intermediate frequency signal is amplitude detected to produce the amplitude component A(1+L+R). This signal is supplied through a capacitor to eliminate the DC component of the signal and thereby supply a sum signal A(L+R) to a matrix circuit. The aforementioned amplitude component of the intermediate frequency signal is also supplied to a negative peak limiter where the minimum level thereof is fixed at a predetermined level and the resultant signal is then supplied to one input of a dividing circuit. The dividing circuit divides the intermediate frequency signal by the output from the negative peak limiter so as to remove the amplitude component from the intermediate frequency signal and thereby provide the phase-modulation component cos ($\omega$t+L−R) of the intermediate frequency signal. This signal is multiplied by a non-modulation carrier sin $\omega$t produced from the intermediate frequency signal and the multiplied output is supplied through a low-pass filter in which the carrier component thereof is removed. The output of the low-pass filter corresponds to the difference signal (L−R) and is supplied to the matrix circuit along with the aforementioned sum signal, the latter circuit functioning to produce the left (L) and right (R) channel stereophonic signals for reproduction.

With this circuit, when the negative modulation is excessive, no noise bursts are produced, whereby noise does not greatly affect the reproduced sound. However, it is to be appreciated that, with this system, the sum signal contains level information A related to the AM stereo signal, whereby the level of the sum signal changes in accordance with changes in the level of the intermediate frequency signal. On the other hand, the difference signal does not contain such level information A and the level of the difference signal thereby does not change with changes in the level of the intermediate frequency signal. As a result, separation between the levels of the sum signal and the difference signal will increase, resulting in deterioration of the reproduced left (L) and right (R) channel stereophonic signals.

There has also been proposed a modification of the latter-mentioned AM stereo system by the applicant herein along with others in which the negative peak limiter is replaced with a capacitor to remove the DC portion of the AM component from the amplitude detector. The output from the capacitor is combined with a fixed DC component which is independent of the level information A. Again, with this system, the same advantages are obtained as with the latter-mentioned system, that is, prevention of noise bursts. Further, although the level of the output of the dividing circuit will change with changes in the level of the intermediate frequency signal, the distortion factor becomes unsatisfactory. In other words, with this system, since the sum signal and difference signal both contain the level information A, the signals supplied to the matrix circuit will both change in accordance with the intermediate frequency signal. However, since the DC component added to the output of the capacitor does not equal the value of the level information A, a complete division operation in the dividing circuit cannot be obtained and an undivided component is mixed with the difference signal to cause distortion.

OBJECTS AND SUMMARY OF THE INVENTION

Accordingly, it is an object of this invention to provide an AM stereo receiver that avoids the above-described difficulties encountered with the prior art.

In particular, it is an object of this invention to provide an AM stereo receiver which prevents the occurence of noise bursts, while also inhibiting deterioration of the distortion ratio and inhibiting undesirable separation between the main channel and sub-channel signals.

In accordance with an aspect of this invention, apparatus for demodulating an AM stereophonic signal of the type having a carrier amplitude-modulated with the sum of left and right channel stereophonic signals and further modulated with the difference of the left and right channel stereophonic signals, comprising tuning means for producing an intermediate frequency signal in response to the AM stereophonic signal; detecting means for producing a sum signal corresponding to the sum of the left and right channel stereophonic signals and having level information, in response to the intermediate frequency signal; negative peak limiter means for restricting the minimum level of the sum signal to produce a restricted sum signal; dividing means for producing a modulation carrier signal in response to the intermediate frequency signal and the restricted sum signal; means for producing a non-modulation carrier signal in response to the intermediate frequency signal; means for producing a level information signal in response to the sum signal; multiplier means for producing a difference signal corresponding to the difference of the left and right channel stereophonic signals in response to the level information signal, the modulation carrier signal, and the non-modulation carrier signal; and matrix means for reproducing the left and right channel stereophonic signals in response to the sum signal and the difference signal.

The above, and other, objects, features and advantages of the invention will become apparent from the following detailed description of illustrative embodiments thereof which is to be read in connection with the accompanying drawings.

DETAILED DESCRIPTION OF THE PREFERRED EMBODIMENTS

Figure 1:
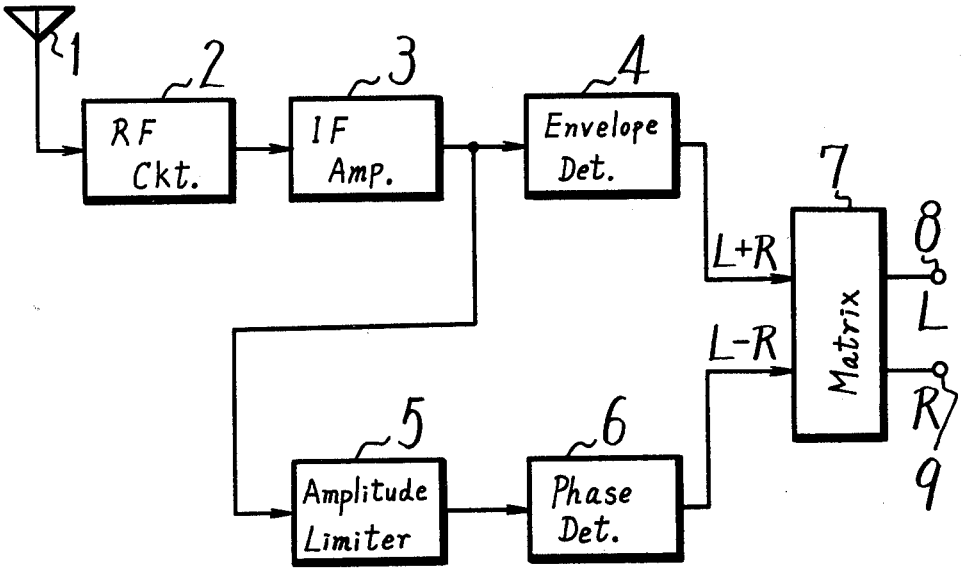
FIG. 1 (PRIOR ART)
FIG. 1 is a block diagram of a stereo signal demodulating circuit for an AM stereo receiver according to the prior art.

Referring to the drawings in detail, and initially to FIG. 1 thereof, there is shown a prior art AM stereo receiver of the type disclosed in U.S. Pat. No. 4,194,088. In particular, the AM stereo receiver includes a high frequency (or radio frequency) tuning circuit 2 supplied with an AM stereo signal from an antenna 1. As an example, high frequency tuning circuit 2 may include a high frequency amplifier, a mixer circuit and a local oscillator (not shown) by which the AM stereo signal is converted to an IF (intermediate frequency) signal. This signal is then supplied to an IF (intermediate frequency) amplifier 3 which produces an IF signal having a carrier AM-modulated with the sum of left (L) and (R) channel stereophonic signals and the carrier phase-modulated with the difference of the left and right channel stereophonic signals.

The IF signal from IF amplifier 3 is supplied to a main channel signal path which includes an AM or envelope detecting circuit 4 for producing a sum signal (L+R). The IF signal from IF amplifier 3 is also fed through a sub-channel signal path comprised of an amplitude limiter 5 which removes the AM-modulation component from the IF signal, and a phase detector 6 which produces a difference signal (L−R) in response the output from amplitude limiter 5. The difference signal (L−R) is supplied along with the sum signal (L+R) to respective inputs of a matrix circuit 7 which, in turn, mixes the signals to thereby produce a main or left (L) channel signal and right (R) or sub-channel signal at output terminals 8 and 9, respectively. In addition, a pilot signal which has been added to the phase-modulated difference component of the transmitted AM stereo signal is separated from the difference signal (L−R) at the output of phase detector 6 for use in a stereophonic display or the like.

Figure 2:
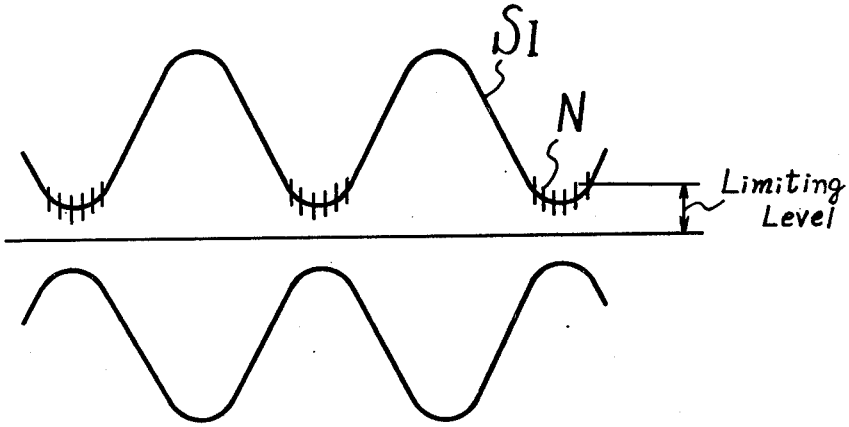
FIG. 2 is a waveform diagram used to explain the operation of the demodulating circuit of FIG. 1.

With the AM stereo receiver of FIG. 1, amplitude limiter 5 in the sub-channel or difference signal path has a strong limiting characteristic to eliminate substantially all amplitude modulations of the IF signal from IF amplifier. However, if a noise component N, as shown in FIG. 2, is superimposed on the IF signal $S_I$ from IF amplifier 3, the operation of amplitude limiter results in the emphasis of such noise such that loud abnormal sounds or noise bursts, for example, scratching or crunching sounds, are produced, which substantially deteriorate the reproduced sound. This phenomenon is particularly noticeable if excessive negative modulation occurs.

In order to overcome the aforementioned disadvantages, it has been proposed to weaken the negative modulation at the transmitter end. Unfortunately, such proposal is not preferred because of deterioration of the reproduced sound.

Figure 3:
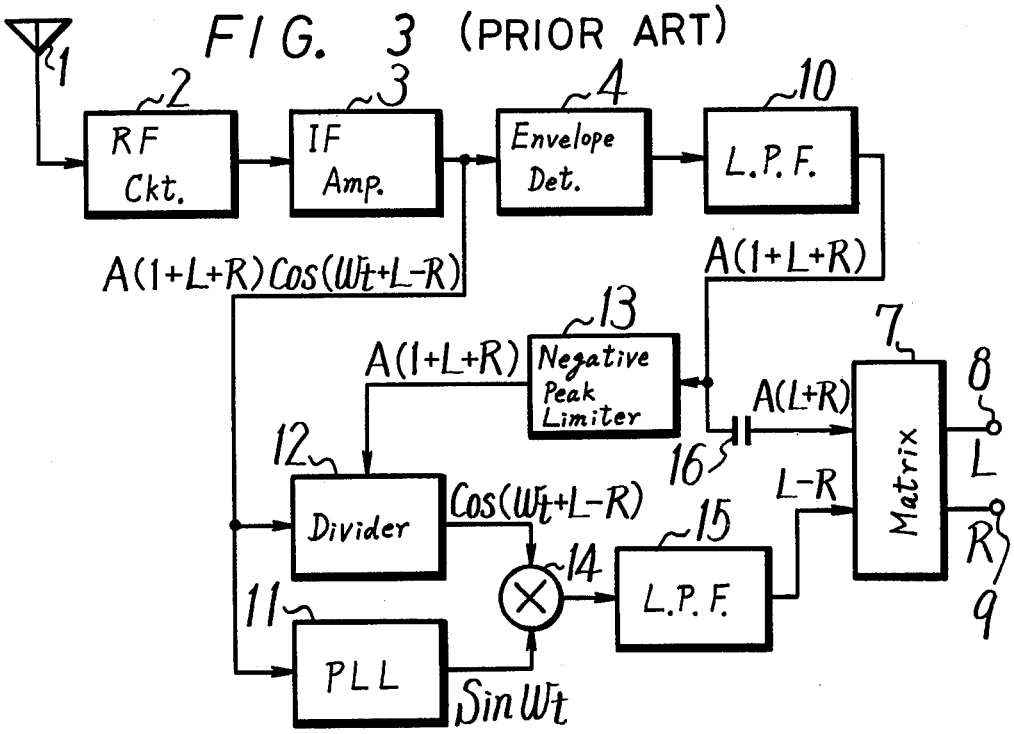
FIG. 3 (PRIOR ART)
FIG. 3. is a block diagram of a stereo signal demodulating circuit for an AM stereo receiver previously proposed by the applicant herein along with others.

Accordingly, the applicant along with others has previously proposed stereo signal demodulating circuits for AM stereo receivers that overcome the aforementioned disadvantages. Referring first to FIG. 3, it will be seen that, in one such previously proposed AM stereo signal demodulating circuit, elements corresponding to those described above with respect to the circuit of FIG. 1 are identified by the same reference numerals and a detailed description thereof will be omitted for the sake of brevity. In particular, a transmitted AM stereo signal is received by an antenna 1 and supplied through a high frequency circuit 2, which is substantially identical to the high frequency circuit in FIG. 1, and then to an IF amplifier 3 which produces an IF signal, which can be expressed as follows:

$$A(1+L+R)\cos\omega t+L-R) \quad (1),$$

where (L+R) represents the aforementioned sum signal, (L−R) represents the aforementioned difference signal, $\omega$ is the angular frequency of the carrier signal and A represents the level information of the AM stereo signal. The AM stereo signal is then envelope detected by an envelope detector 4 and supplied to a low-pass filter 10 where the carrier component is eliminated, to produce the following signal:

$$A(1+L+R) \quad (2).$$

This signal is supplied through a capacitor 16 which removes the DC component therefrom to produce a sum signal A(L+R) which is supplied to one input of a matrix circuit 7.

The signal A(1+L+R) from low-pass filter 10 is also fed to a negative peak limiter 13 which limits the minimum value or negative peak value of the signal from low-pass filter 10. In particular, the level of the signal A(1+L+R) is restricted to prevent such signal, which is proportional to the level of the intermediate frequency signal, from approximately being equal to zero. The reason for the negative peak limiter 13 is that the output therefrom is provided as a divisor signal to a dividing circuit 12 which divides the intermediate frequency signal by the output of negative peak limiter 13. If the output of negative peak limiter 13 is approximately equal to zero, the output from dividing circuit 12 will be excessively large. For example, the limiting level of negative peak limiter 13 may become operative when the level of the signal A(1+L+R) is approximately in the range of 0.05–0.2 A. It is to be appreciated that, when the modulation results in the level of the signal from low-pass filter 10 being beyond this limiter level, distortion will probably be caused in the sub-channel or difference signal by the remaining amplitude-modulation component. However, this distortion is minimal since it occurs in short intervals during a single period and is completely different from the noise bursts, such as the aforementioned scratching and crunching sounds, that result from use of amplitude limiter 5 in the circuit of FIG. 1. The minimal distortion caused by the circuit of FIG. 3, however, is virtually inaudible when reproduced.

As previously described, the signal A(1+L+R), the level of which has been set or limited to a predetermined level by negative peak limiter 13, as described above, is supplied to dividing circuit 12 which divides the IF signal A(1+L+R) cos ($\omega$t+L−R) produced at the output of IF amplifier 3 by the output of negative peak limiter 13, as follows:

$$\frac{A(1+L+R)\cos(\omega t+L-R)}{A(1+L+R)} = \cos(\omega t+L-R). \quad (3)$$

Accordingly, the phase-modulation component cos ($\omega$t+L−R) is supplied to one input of a multiplier 14.

In addition, the IF signal from IF amplifier 3 is supplied to a phase-locked loop (PLL) 11 which produces a non-modulation carrier sin $\omega$t from the IF signal which is supplied to multiplier 14 and which is multiplied with the phase-modulation signal cos ($\omega$t+L−R) from dividing circuit 12, as follows:

$$\sin \omega t \cdot \cos(\omega t+L-R) = \tfrac{1}{2}\sin(L-R) + \tfrac{1}{2}\sin(2\omega t+L-R) \quad (4).$$

The output from multiplier 14 is supplied to a low-pass filter 15 in which the carrier component thereof is removed. The output signal from low-pass filter 15 can be expressed as follows:

$$\tfrac{1}{2}\sin(L-R) \quad (5).$$

It is to be appreciated that, if (L−R) is small, sin (L−R)≃(L−R). Accordingly, equation (5) can be approximated as follows:

$$\tfrac{1}{2}\sin(L-R) \simeq \tfrac{1}{2}(L-R) \quad (6),$$

where any error due to such approximation is negligibly small where there is a low degree of modulation. It should therefore be appreciated that the output signal from low-pass filter 15 is a difference signal which is supplied to another input of matrix circuit 7 and which is thereby mixed with the sum signal A(L+R) to produce the left (L) and right (R) channel stereophonic signals at output terminals 8 and 9, respectively.

With the circuit of FIG. 3, in which a constant restriction or limiting value is set with respect to the demodulated sum signal, since the IF signal is divided by the restricted or limited sum signal and the result multiplied with a non-modulation carrier to achieve a desired frequency signal, when modulation at the transmission side becomes excessive, no noise bursts will be produced. It is to be appreciated that, with the arrangement of negative peak limiter 13, the division operation by dividing circuit 12 can be carried out accurately even when the level of the IF signal from IF amplifier 3 changes so that the distortion ratio will not be degraded. However, with the circuit of FIG. 3, it is to be appreciated that the sum signal contains level information A related to the level of the AM stereo signal, but the difference signal does not contain such level information A. In this manner, the level of the sum signal supplied to matrix circuit 7 from the main channel changes in response to level changes in the IF signal, while no such changes occur in the difference signal supplied to matrix circuit 7 from the sub-channel. As a result, separation between the signals in both channels, and the output channel stereophonic signals, deteriorates.

Figure 4:
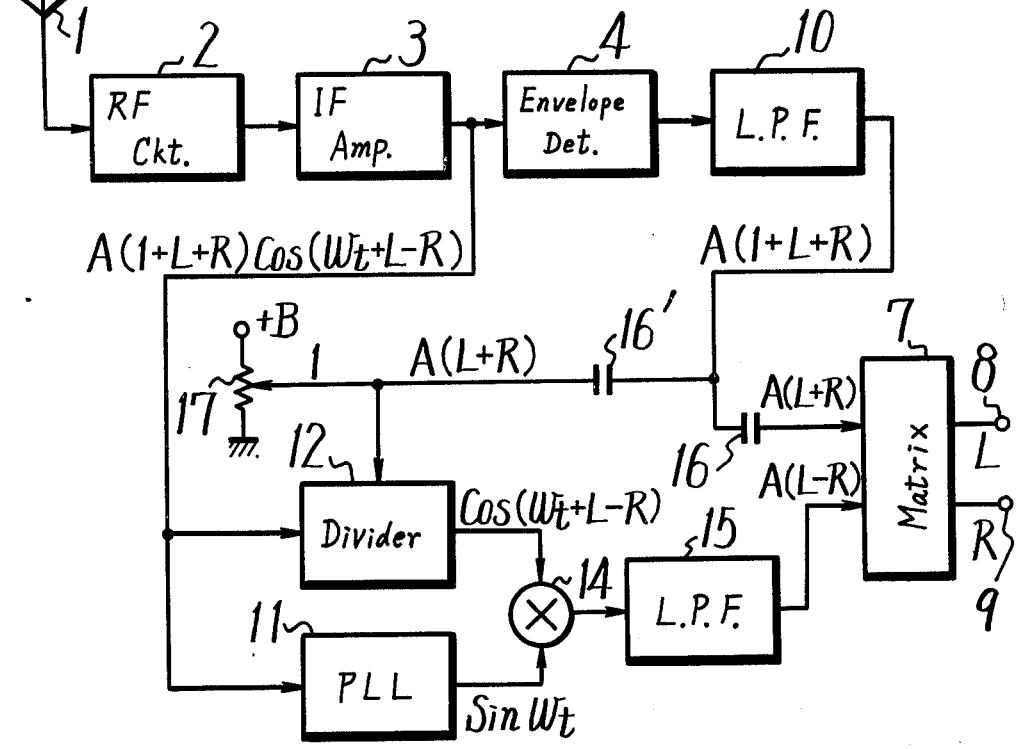
FIG. 4 (PRIOR ART)
FIG. 4 is a block diagram of a stereo signal demodulating circuit for an AM stereo receiver previously proposed by the applicant herein along with others.

Referring now to FIG. 4, there is shown a modification, previously proposed by the applicant herein and others, of the circuit of FIG. 3. In particular, negative peak limiter 13 is replaced by a capacitor 16' which removes the DC component from the output of low-pass filter 10 to produce the sum signal A(L+R) which is supplied to one input of dividing circuit 12. In addition, a variable resistor 17 is connected between a DC voltage supply source +B and ground and is connected to the connection point between capacitor 16' and the aforementioned input of dividing circuit 12. Variable resistor 17 provides a DC component 1 having a fixed level to the aforementioned input of dividing circuit 12 supplied with the output from capacitor 16'. With this arrangement, even if the strength of the electric field intensity of the broadcast wave is lowered, resulting in a change in the level of the IF signal, the gain of dividing circuit 12 does not change. In this manner, the levels of the sum and difference signals change in the same direction in response to changes in the level of the AM stereo signal so that separation between the channel signals is not degraded. In addition, as previously discussed in regard to the circuit of FIG. 3, the noise bursts which result with the circuit of FIG. 1 are eliminated.

In regard to the circuit of FIG. 4, since the DC component of the sum signal supplied to dividing circuit 12 does not contain the level information A, the gain of dividing circuit 12 is not changed by such level information A. The output of dividing circuit 12, however, does change in response to changes in the level of the IF signal which results in deterioration of the distortion ratio. In particular, since the DC component added to the sum signal and supplied to dividing circuit 12 does not contain the level information A, and since the amplitude-modulation component of the IF signal contains such level information A, the amplitude-modulation component of the IF signal will not be completely divided by the output from negative peak limiter 13 in dividing circuit 12. As a result, a ramainder or amplitude component will be produced at the output of dividing circuit 12 which will be mixed with the phase-modulation component, thereby resulting in distortion.

Figure 5:
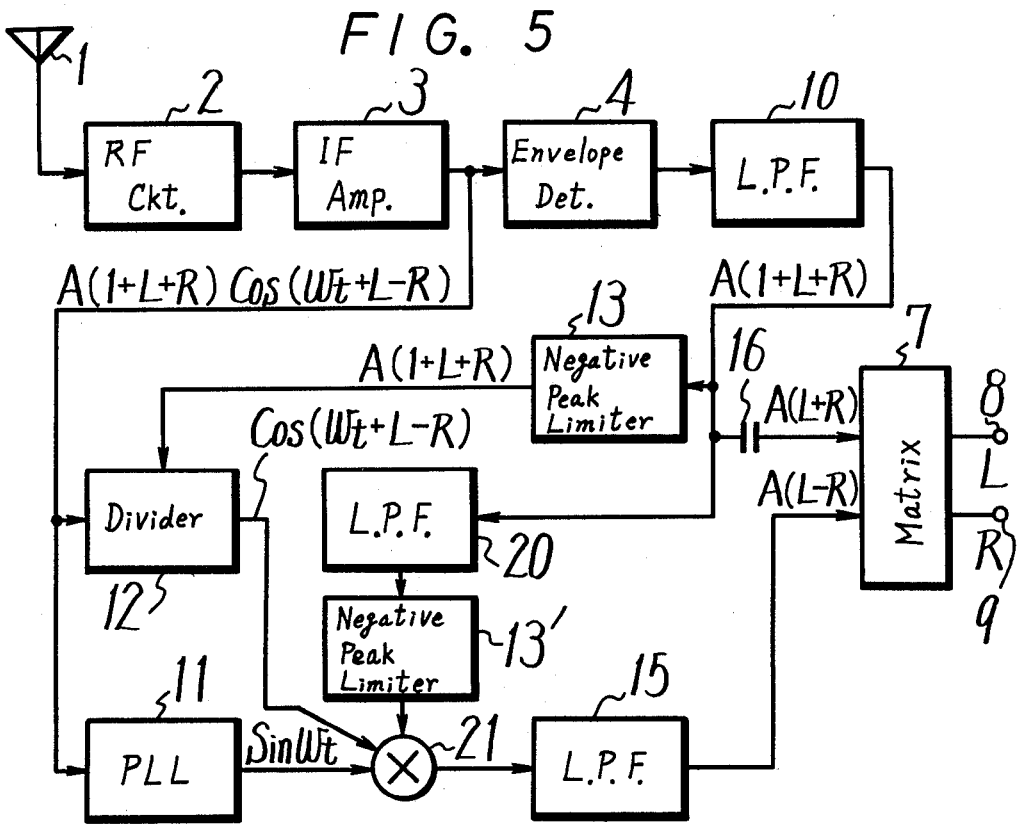
FIG. 5 is a block diagram of a stereo signal demodulating circuit for an AM stereo receiver according to one embodiment of this invention.

Referring now to FIG. 5, it will be seen that, in an AM stereo receiver according to one embodiment of this invention, elements corresponding to those described above in regard to the circuits of FIGS. 3 and 4 are identified by the same reference numerals, and a detailed description thereof will be omitted herein for the sake of brevity. The circuit of FIG. 5 is similar to that of FIG. 3 with the modification that a level information signal is supplied to the multiplier circuit. In particular, the amplitude-modulation signal $A(1+L+R)$ from low-pass filter 10 is supplied to a second low-pass filter 20 to remove the amplitude-modulation component $(1+L+R)$ therefrom and thereby produce a signal corresponding only to the level information A. This signal is then supplied to a second negative peak limiter 13' for restricting the minimum or negative peak value of the level information signal, and the resultant signal is supplied to an input of a multiplier 21 which is also supplied with the non-modulation signal from PLL 11 and the phase-modulation signal from dividing circuit 12, as previously discussed in regard to FIG. 3. Accordingly, multiplier 21 multiplies together the phase-modulation component $\cos(\omega t+L-R)$ of the IF signal from dividing circuit 12, the non-modulation carrier $\sin \omega t$ from PLL 11 and the level information signal A from low-pass filter 20 and second negative limiter 13'. The output signal from multiplier 21 is supplied to low-pass filter 15 which removes the carrier component therefrom and produces the difference signal containing the level information A, that is, a signal $A(L-R)$.

It is to be appreciated that the AM stereo receiver of FIG. 5 overcomes the disadvantages of the circuits of FIGS. 3 and 4. In particular, since the sum signal and the difference signal supplied to matrix circuit 7 each contain the level information A of the AM stereo signal, even if the levels of the respective signals vary in accordance with variations in the level of the IF signal, there will be no deterioration in the separation between the sum and difference channel signals. In addition, since the divisor signal supplied to dividing circuit 12 from negative peak limiter 13 contains the level information A, dividing circuit 12 completely eliminates the amplitude-modulation component of the IF signal to produce only the phase-modulation component thereof. In this manner, even when the level of the IF signal changes, an accurate division operation, in accordance with equation (3), is obtained so that no remainder is mixed into the phase-modulation component from dividing circuit 12 and thereby into the difference signal supplied to matrix circuit 7.

Figure 6:
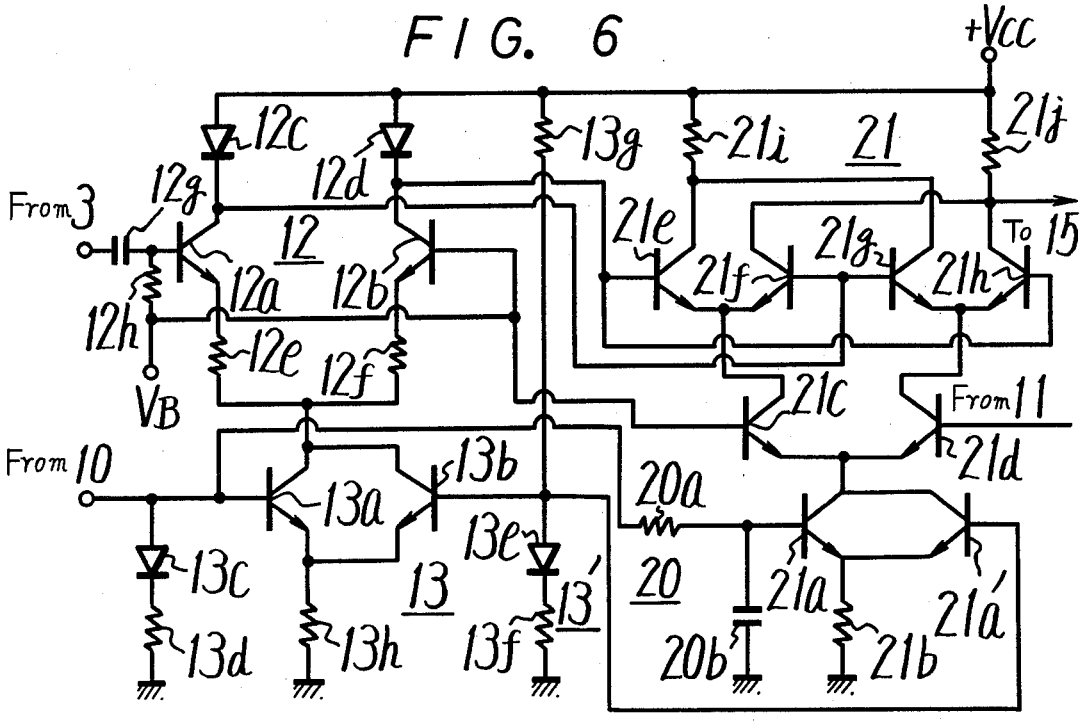
FIG. 6 is a circuit-wiring diagram of a portion of the stereo signal demodulating circuit of FIG. 5.

Referring now to FIG. 6, there is shown a circuit-wiring diagram of one embodiment of a portion of the circuit of FIG. 5 according to this invention. As shown therein, dividing circuit 12 includes a differential amplifier comprised of two NPN transistors 12*a* and 12*b*, with the base of transistor 12*a* being supplied with the IF signal from IF amplifier 3 through a capacitor 12*g*. The base of transistor 12*a* is also connected to a bias voltage supply source $V_B$ through a bias resistor 12*h*, and the base of transistor 12*b* is directly coupled to such bias voltage supply source $V_B$. In addition, the load circuits for transistors 12*a* and 12*b* are comprised of diodes 12*c* and 12*d*, respectively, connected between the collectors of transistors 12*a* and 12*b* and a positive voltage supply source $+V_{cc}$. In particular, the cathodes of the diodes are connected to the collectors of the respective transistors and the anodes thereof are connected to positive voltage supply source $+V_{cc}$. The emitters of transistors 12*a* and 12*b* are connected to each other through resistors 12*e* and 12*f*, with the common connection point between such resistors being supplied with the output from negative peak limiter 13. The phase-modulation component $\cos(\omega t+L-R)$ is produced as a differential output signal at the collectors of transistors 12*a* and 12*b*.

Negative peak limiter 13 includes two NPN transistors 13*a* and 13*b* having their emitters commonly connected to ground through a resistor 13*h* and their collectors commonly connected to the connection point between resistors 12*e* and 12*f* of dividing circuit 12 for supplying the amplitude-modulation component thereto. The base of transistor 13*a* is supplied with the amplitude-modulation component of the IF signal from low-pass filter 10. The base of transistor 13*a* is also connected to ground through a series connection of a diode 13*c* and a resistor 13*d*. In this regard, transistor 13*a* and diode 13*c* form a first current mirror circuit. In like manner, the base of transistor 13*b* is connected to ground through the series connection of a diode 13*e* and a resistor 13*f* and is also connected to positive voltage supply source $+V_{cc}$ through a resistor 13*g* which functions as a reference current supply source. Transistor 13*b* and diode 13*e* form a second current mirror circuit. In this manner, by means of the reference current flowing through the second current mirror circuit and set by resistor 13*g*, a negative peak or minimum value of the signal passing through the first current mirror circuit is controlled or restricted.

The amplitude-modulation sum signal from low-pass filter 10 is also supplied through low-pass filter 20 to the base of an NPN transistor 21*a*. Low-pass filter 20 includes a resistor 20*a* connected in series between low-pass filter 10 and the base of transistor 21*a*, and a capacitor connected between ground and the connection point of resistor 20*a* and the base of transistor 21*a*. The time constant of resistor 20*a* and capacitor 20*b* is set so as to eliminate the amplitude-modulation component so that only the level information is produced. A transistor 21*a*, along with the second current mirror circuit, forms second negative peak limiter 13', and also forms a third current mirror circuit with diode 13*e*. In particular, the base of transistor 21*a* is connected to the connection point between diode 13*e* and resistor 13*g*. The emitters of transistors 21*a*' and 21*a* are commonly connected to ground through a resistor 21*b* and also have their collectors commonly connected together. The third current mirror circuit comprised of transistor 21a' and diode 13e limits the negative peak value of current flowing through transistor 21a'.

In addition, transistors 21a and 21a' part of multiplier 21. Multiplier 21 also includes two NPN transistors 21c and 21d which form a differential amplifier. In this regard, the emitters of transistors 21c and 21d are commonly connected to the collector of transistor 21a and are thereby supplied with the level information signal A therefrom. The base of transistor 21c is supplied with the IF signal from IF amplifier 3 through capacitor 12g and reisitor 12h, and the base of transistor 21d is supplied with the non-modulation component sin ωt from PLL 11. A second differential amplifier comprised of transistors 21e and 21f have their emitters commonly connected to the collector of transistor 21c. In addition, a third differential amplifier is provided and includes two NPN transistors 21g and 21h having their emitters commonly connected to the collector of transistor 21d. The bases of transistors 21e and 21h are supplied with the output signal at the collector of transistor 12b of dividing circuit 12, and the bases of transistors 21f and 21g are supplied with the output signal at the collector of transistor 12a. The collectors of transistors 21e and 21g are commonly connected to positive voltage supply source $+V_{cc}$ through a resistor 21i and the collectors of transistors 21f and 21h constitute the output of multiplier 21 which is supplied to low-pass filter 15. The collectors of transistors 21f and 21h are also connected to positive voltage supply source $+V_{cc}$ through a resistor 21j.

In operation, dividing circuit 12 utilizes changes in the operating resistances of diodes 12c and 12d which are inversely proportional to the current flowing through the diodes to perform the division operation. The differential output from transistors 12a and 12b can be expressed by the product of the current flowing through these transistors times the operating resistances of diodes 12c and 12d. Accordingly, the current flowing through diodes 12c and 12d, which also flows through transistors 12a and 12b, is controlled so as to be proportional to the amplitude-modulation sum signal from low-pass filter 10 supplied to the base of transistor 13a of negative peak limiter 13. In this manner, the differential output signal from dividing circuit 12 is inversely proportional to the output signal from negative peak limiter 13, that is, the signal supplied to the emitters of transistors 12a and 12b. Thus, a divided signal is produced as the differential output signal from transistors 12a and 12b.

Accordingly, the differential output signal at the collectors of transistors 12a and 12b is supplied to the bases of transistors 21f and 21g and transistors 21e and 21h, respectively, of multiplier 21. In addition, the amplitude-modulation output signal from low-pass filter 10 is further supplied to low-pass filter 20 comprised of resistor 20a and capacitor 20b, and the output therefrom is supplied to second negative peak limiter 13'. Accordingly, the output from second negative peak limiter 13' at the collector of transistor 21a is supplied to the emitters of transistors 21c and 21d of multiplier 21. It is to be appreciated that the amplitude-modulation component is removed in low-pass filter 20 to produce only the level information signal A which is supplied to multiplier 21. In addition, the output signal from PLL 11 is supplied to the base of transistor 21d. In this manner, the phase-modulation signal cos (ωt+L−R) from dividing circuit 12, the non-modulation signal sin ωt from PLL 11 and the level information signal A from low-pass filter 20 and second negative peak limiter 13' are multiplied with each other, and the output from multiplier 21 is thereafter supplied to low-pass filter 15.

As previously discussed in detail, since the non-modulation component is multiplied with the output of dividing circuit 12 to produce the sub-channel signal, noise bursts and the like will not result under the condition of excessive negative modulation or when the signal-to-noise (S/N) ratio deteriorates. Further, even if the level of the IF signal changes, separation between the signals in both channels, and accordingly, the distortion ratio, will not deteriorate as with the aforementioned circuits.

It is to be appreciated that various modifications can be made within the scope of the present invention as defined in the claims herein. For example, it is possible to supply the amplitude-modulation component A(1+L+R) to low-pass filter 20 from negative peak limiter 13 rather than from low-pass filter 10. Further, it is to be appreciated that although multiplier 21 has been provided to multiply the phase-modulation component cos (ωt+L−R), the non-modulation component sin ωt and the level information signal A together, these signals may be multiplied in any other order to obtain the difference signal. For example, the phase-modulation component cos (ωt+L−R) can be multiplied with the non-modulation component sin ωt and the result thereof then multiplied by the level information signal A. Alternatively, the phase-modulation output from dividing circuit 12 can first be multiplied with the level information signal A and the resulting signal thereof then multiplied by the output signal from PLL 11. As a further example, the IF signal from IF amplifier 3 can be multiplied by the output signal from PLL 11, the result thereof then divided by the amplitude-modulation signal from negative peak limiter 13 and then multiplied by the level information signal A. As a still further example, the IF signal can be multiplied by the output signal from PLL 11, the resulting signal then multiplied by the level information signal A from low-pass filter 20 and second negative peak limiter circuit 13', and then divided by the amplitude-modulation signal from negative peak limiter 13. In addition, it is to be appreciated that the AM stereo signal demodulating circuit according to the present invention is not limited for use with the AM stereo receiver described above and, for example, may be used in other systems, such as that disclosed in U.S. Pat. Nos. 3,908,090 and 4,018,994.

Having described specific preferred embodiments of this invention with reference to the accompanying drawings, it is to be understood that the present invention is not limited to those specific embodiments, and that various changes and modifications may be effected therein by one skilled in the art without departing from the scope or spirit of the invention as defined in the appended claims.

1. Apparatus for demodulating an AM stereophonic signal of the type having a carrier amplitude-modulated with the sum of left and right channel stereophonic signals and the carrier phase-modulated with the difference of said left and right channel stereophonic signals, comprising:

tuning means for producing an intermediate frequency signal in response to said AM stereophonic signal, said intermediate frequency signal having a first amplitude component including amplitude-modulation information corresponding to said sum and also including level information;

detecting means responsive to said intermediate frequency signal for producing a sum signal corresponding to the sum of said left and right channel stereophonic signals and having an amplitude component equal to said first amplitude component;

means responsive to said intermediate frequency signal in combination with said sum signal for producing a difference signal corresponding to the difference between said left and right channel stereophonic signals with said first amplitude component being removed exactly therefrom;

means for producing from said sum signal a level information signal corresponding only to said level information, and having a second amplitude component including only said level information;

means for combining said level information signal with said difference signal to form a level adjusted difference signal having said second amplitude component; and matrix means for reproducing said left and right channel stereophonic signals in response to said sum signal and said level adjusted difference signal.

2. Apparatus according to claim 1; in which said detecting means includes an envelope detector for producing said sum signal.

3. Apparatus according to claim 2; in which said sum signal includes a DC component; and further including capacitance means for removing said DC component from said sum signal and for supplying said sum signal with said DC component removed to said matrix means.

4. Apparatus according to claim 1; in which said means for producing a difference signal includes dividing means for producing a phase-modulation signal in response to said intermediate frequency signal and said sum signal; means for producing a non-modulation signal in response to said intermediate frequency signal; and multiplier means for multiplying said phase-modulation signal and said non-modulation signal.

5. Apparatus according to claim 1; in which said first amplitude component includes an amplitude-modulation component, and said means for producing said level information signal includes means for removing said amplitude-modulation component from said sum signal to produce said level information signal.

6. Apparatus according to claim 5; in which said means for removing said amplitude-modulation component includes a low-pass filter.

7. Apparatus according to claim 5; in which said means for producing said level information signal further includes limiter means for limiting the minimum level of said level information signal.

8. Apparatus according to claim 1; in which said means for combining includes multiplier means for multiplying said difference signal and said level information signal.

9. Apparatus according to claim 1; in which said difference signal includes a carrier component; and further including filter means for removing said carrier component from said difference signal and for supplying said difference signal with the carrier component removed to said matrix means.

10. Apparatus according to claim 1; further including limiter means for limiting the minimum level of said sum signal from said detecting means.

11. Apparatus according to claim 10; in which said means for producing said level information signal produces said level information signal in response to said sum signal with its minimum level limited from said limiter means.

12. Apparatus according to claim 10; in which said means for producing a difference signal includes dividing means for producing a phase-modulation signal in response to said intermediate frequency signal and said sum signal with its minimum level limited; means for producing a non-modulation signal in response to said intermediate frequency signal; and multiplier means for multiplying said phase-modulation signal and said non-modulation signal.

13. Apparatus for demodulating an AM stereophonic signal of the type having a carrier amplitude-modulated with the sum of left and right channel stereophonic signals and said carrier phase-modulated with the difference of said left and right channel stereophonic signals, comprising:

tuning means for producing an intermediate frequency signal in response to said AM stereophonic signal, said intermediate frequency signal having a first amplitude component including amplitude modulation information and level information;

detecting means for producing a sum signal corresponding to the sum of said left and right channel stereophonic signals in response to said intermediate frequency signal and having an amplitude component equal to said first amplitude component;

dividing means for producing a phase-modulation signal having phase-modulation information in response to said intermediate frequency signal and said sum signal, with said first amplitude component being exactly removed from said phase modulation signal;

means for producing a non-modulation signal in response to said intermediate frequency signal;

means for removing said amplitude modulation information from said sum signal to produce a level information signal having a second amplitude component corresponding only to said level information;

multiplier means for producing a difference signal corresponding to the difference of said left and right channel stereophonic signals in response to said level information signal, said phase modulation signal and said non-modulation signal; and matrix means for reproducing said left and right channel stereophonic signals in response to said sum signal and said difference signal.

14. Apparatus according to claim 13, in which said means for removing includes low-pass filter means.

15. Apparatus according to claim 13; in which said difference signal includes a carrier component; and further including filter means for removing said carrier component from said difference signal and for supplying said difference signal with the carrier component removed to said matrix means.

16. Apparatus according to claim 13; further including limiter means for limiting the minimum level of said sum signal from said detecting means.

17. Apparatus according to claim 16; in which said means for removing produces said level information signal in response to said sum signal with its minimum level limited from said limiter means.

* * * * *